US006577838B2

(12) United States Patent
Fujita et al.

(10) Patent No.: US 6,577,838 B2
(45) Date of Patent: Jun. 10, 2003

(54) FIXING APPARATUS

(75) Inventors: Takashi Fujita, Chiba (JP); Jiro Ishizuka, Ibaraki (JP); Keisuke Inoue, Nagano (JP); Shozo Shimada, Miyazaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/014,429

(22) Filed: Dec. 14, 2001

(65) Prior Publication Data

US 2002/0094218 A1 Jul. 18, 2002

(30) Foreign Application Priority Data

Dec. 18, 2000 (JP) ..... 2000-384002

(51) Int. Cl.[7] ..... G03G 15/20
(52) U.S. Cl. ..... 399/325
(58) Field of Search ..... 399/67, 69, 320, 399/324, 325, 328; 219/216; 118/DIG. 1, 60, 101, 260, 264, 268, 270

(56) References Cited

U.S. PATENT DOCUMENTS

| | | | | |
|---|---|---|---|---|
| 5,145,525 A | * | 9/1992 | Fromm et al. | 118/260 |
| 5,146,271 A | * | 9/1992 | Hoover | 399/325 X |
| 5,563,695 A | | 10/1996 | Sakurai et al. | 399/327 |
| 5,966,578 A | | 10/1999 | Soutome et al. | 399/333 |
| 6,272,307 B1 | | 8/2001 | Ishizuka et al. | 399/325 |

* cited by examiner

*Primary Examiner*—Hoan Tran
(74) *Attorney, Agent, or Firm*—Fitzpatrick, Cella, Harper & Scinto

(57) ABSTRACT

If heat is deprived from the upper surface of a fixing roller, fixability of a fixing roller is lowered and may cause fixing failure. Furthermore, output recording material vary in glossiness, or there appears unevenness on the recording materials. A fixing apparatus, which is capable of suppressing reduction of a temperature of the surface of a fixing rotary body on the recording materials, is provided for reducing fixability of a fixing roller or fixing failure.

9 Claims, 5 Drawing Sheets

FIXING APPARATUS

BACKGROUND OF THE INVENTION

1. Field of the Invention

The present invention relates to a fixing apparatus that is suitably used for an image forming apparatus employing an electrophotographic method or an electrostatic recording method and fixes an unfixed image. More particularly, the present invention relates to a fixing apparatus including a releasing liquid applying mechanism.

2. Related Background Art

As a fixing apparatus for applying a releasing agent (hereinafter referred to as the "oil"), such as silicone oil, to a fixing roller, there have conventionally been proposed an apparatus that applies the oil to the fixing roller using felt, an apparatus that draws up the oil using felt and applying the drawn-up oil to the fixing roller through an applying roller, an apparatus that draws up the silicone oil using a draw-up roller, and the like. FIG. 6 attached hereto shows the fixing apparatus that draws up the silicone oil using the draw-up roller.

In the apparatus shown in FIG. 6, symbol P represents an oil pan P as a releasing agent containing means for silicone oil O. A first draw-up roller 43 as a releasing agent drawing-up means is partially immersed in the oil O in the oil pan P, and a second draw-up roller 42 as a releasing agent drawing-up means rotates while contacting the first draw-up roller 43 or with a gap therebetween. The first and second draw-up rollers 42 and 43 are rotatively driven by a driving source (not shown). Further, an applying roller 41 as a releasing agent applying means, which is rotatively driven by a driving source (not shown), rotates in contact with the second draw-up roller 42. The applying roller 41 is freely switched between a position in which the applying roller 41 contacts a fixing roller 4*a* and a position in which the applying roller 41 is separated from the fixing roller 4*a*. Alternatively, the applying roller 41 is provided so as to contact the fixing roller 4*a* at all times. With this construction, the drawn-up oil O is applied to the surface of the fixing roller 4*a*.

It should be noted here that reference numeral 4*b* denotes a pressurizing roller that rotates in pressure contact with the fixing roller 4*a*. A nip portion between these rollers 4*a* and 4*b* heated by halogen heaters 45*a* and 45*b* fixes an image by transporting a recording material with pressure thereon. Here, the halogen heaters 45*a* and 45*b* are respectively disposed at the centers of the rollers 4*a* and 4*b*. Also, a metering blade 44 as a releasing agent regulating means contacts the applying roller 41. The metering blade 44 is biased by a spring 49 so that the metering blade 44 is pressed against the applying roller 41 with constant pressure at all times. Also, the metering blade 44 is made of an elastic body, such as fluororubber. With this construction, the amount of oil on the applying roller 41 is regulated to a predetermined value.

However, the temperature of the releasing agent is lower than that of the fixing roller, so that when the releasing agent is applied onto the fixing roller, the applied releasing agent deprives heat from the surface of the fixing roller.

As a result, the fixability is lowered. In particular, immediately after an apparatus is activated, the temperature of the releasing agent is close to room temperature, which leads to the lowest fixability and may cause fixing failures.

Also, the surface of the fixing roller is formed by coating the surface of a metal core with silicone rubber or fluororubber. With this construction, a certain nip is maintained when a recording material is pinched between the rollers.

Alternatively, there is used a fixing roller that is provided with a Teflon coat due to releasing property. This means that the fixing roller basically has a low heat conduction.

If heat is deprived from the upper surface of such a fixing roller, it takes long time to conduct heat from a lower layer. Consequently, when fixing is successively performed for recording materials, even if there occurs no fixing failure, outputted recording materials vary in glossiness or there appears unevenness on the recording materials. This degrades quality on the recording materials.

SUMMARY OF THE INVENTION

An object of the present invention is to provide a fixing apparatus that is capable of suppressing reduction of a temperature of the surface of a fixing rotary body due to a releasing liquid.

Another object of the present invention is to provide a fixing apparatus that prevents variations of glossiness during a successive fixing operation.

Still another object of the present invention is to provide a fixing apparatus comprising a fixing rotary body for fixing an unfixed image on a supporting material, an applying member for applying a releasing liquid onto said fixing rotary body, a containing means for containing the releasing liquid and a supplying member contacting the releasing liquid in the containing means for supplying the releasing liquid to said applying member, wherein the containing means includes an outer vessel and an inner vessel for isolating said supplying member from said outer vessel.

Other objects of the present invention will become apparent from the following description.

DESCRIPTION OF THE PREFERRED EMBODIMENTS

The present invention will be described below by taking, as an example, a case where a copying machine employing an electrophotographic method is used.

Figure 1:
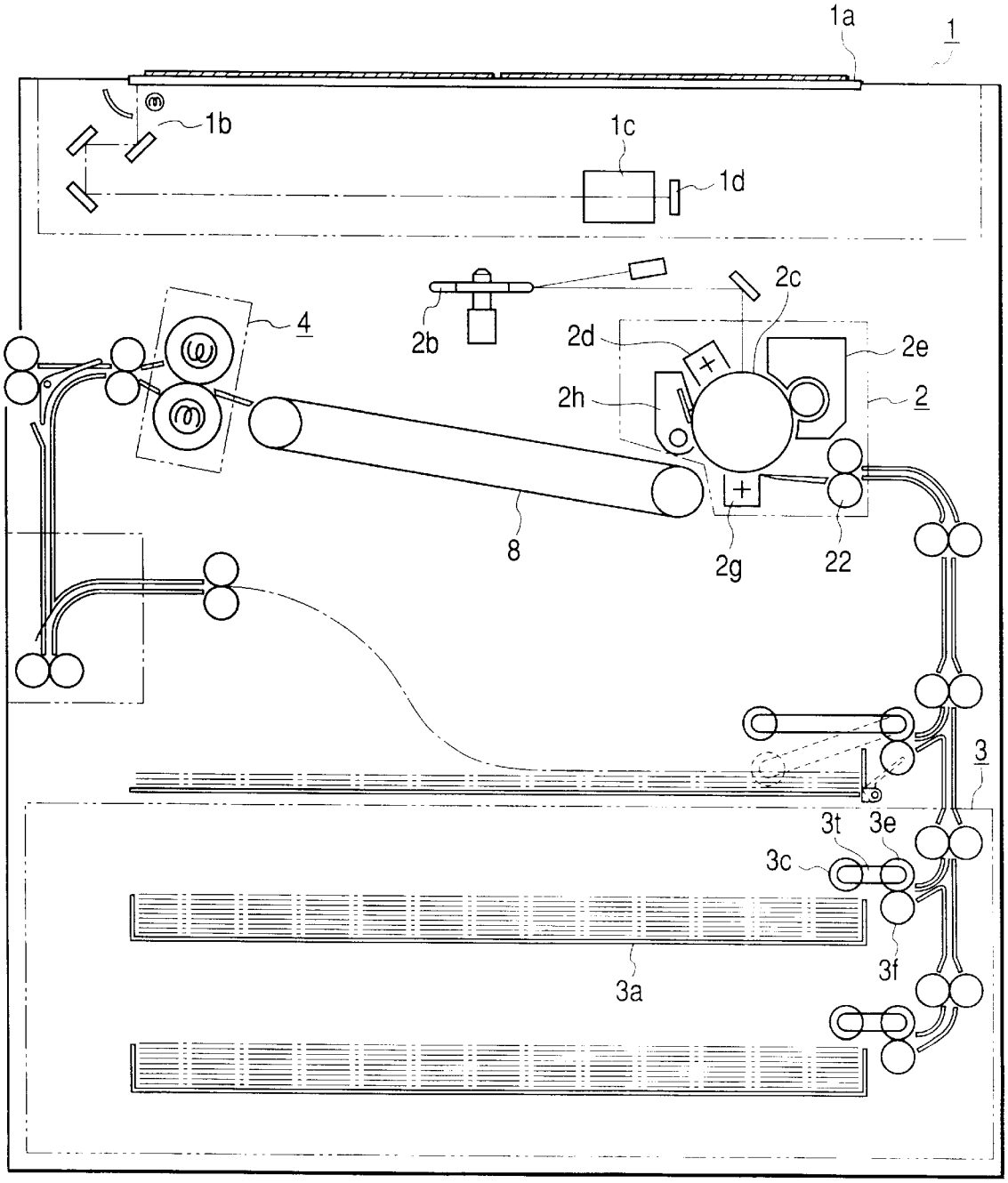
FIG. 1 is a schematic cross-sectional view showing the overall construction of an image forming apparatus according to an embodiment of the present invention.

FIG. 1 is a cross sectional view showing the schematic construction of the copying machine according to the present embodiment. First, the schematic construction of the copying machine will be described with reference to FIG. 1. In this copying machine, a reader unit 1 including a scanning optical system reads image information. The image information is photoelectrically converted and is transferred to an image forming unit 2. In the image forming unit 2, an image is formed on a sheet fed by a sheet feeding unit 3. The sheet on which the image has been formed is transported to a fixing apparatus 4 and heat and pressure are applied thereto to fix a transferred image. A series of operations performed during an electrophotographic process is known and therefore is not described in detail here.

[Reader Part (unit)]

A document placed on a document-supporting glass 1*a* is irradiated with light by a scanning optical system 1*b* having a light source and a group of reflection mirrors, and reflected light is imaged on a CCD 1*d* through a reduction lens 1*c* and is photoelectrically converted. After being A/D converted, this image information is transferred to a memory. The maximum document size is LTR or A3.

[Feeding Part (unit)]

A sheet feeding cassette 3*a* that carries and contains sheets is detachably provided in the lower portion of the copying machine.

A solenoid (not shown) coupled to a pickup roller 3*c* is turned on during standby, so that the pickup roller 3*c* is separated from a surface of the sheets.

Following this, when feeding a sheet, the solenoid is turned off, so that the pickup roller 3*c* is brought into contact with the sheet surface. Then, the first sheet is fed by the pickup roller 3*c* that receives a rotational driving force. The driving force for the pickup roller 3*c* is transmitted from a transport roller 3*e* through a timing belt 3*t*.

The picked-up sheet is transported while being pinched between the transport roller 3*e* and a retard roller 3*f*. The transport roller 3*e* receives a rotational driving force in a direction in which the sheet is to be transported, while the retard roller 3*f* is rotatively driven through a torque limiter (not shown) in a direction opposite to the transport direction. Accordingly, only the front end of the first sheet exists between these rollers. Therefore, the torque limiter gives in to the friction force between the sheet and the roller and the retard roller 3*f* rotates in the transport direction. Next, if several overlapping sheets reach the pinching portion between these rollers, the friction force between the first and second sheets gives in to the torque limiter and therefore the retard roller 3*f* is rotated in a direction opposite to the transport direction. As a result, only the uppermost sheet is separated and fed in advance. Even if a plurality of sheets are picked up at the same time, only the uppermost sheet is separated and fed in advance by the same operation.

The sheet feeding operation described above makes it possible to feed the carried sheets one by one.

(Transport Part)

The sheet fed by the sheet feeding unit 3 is temporarily stopped at the front end thereof by the resist roller 22 and is fed again in accordance with the image formed by the image forming unit 2. The image is transferred in a transferring unit. The resist roller 22 is rotatively driven by coupling a clutch (not shown) under the control by a controller of a main body.

(Image Forming Part)

A laser light emitting unit 2*a* emits laser light under the control by a laser driver in accordance with image information read by the reader unit 1. Then, the emitted laser light is scanned in the generating line direction of a photosensitive drum 2*c* by the rotation of a polygon mirror 2*b,* and a latent image is formed on the surface of the drum that has been charged in advance by a charger 2*d.* This latent image is developed by a developer 2*e* provided around the photosensitive drum 2*c,* and a toner image is transferred by a transfer charger 2*g* onto a sheet transported by a pair of pre-transfer rollers 2*f.* After this image transfer operation, residual toner on the drum surface is removed by a cleaner 2*h.*

(Fixing Part)

The sheet S onto which the toner image has been transferred in the image forming unit 2 is introduced into a fixing apparatus 4 by a transport belt 8. When passing between a fixing roller 4*a* and a pressurizing roller 4*b,* the sheet is given heat and pressure. As a result, the toner image melts and adheres to the sheet.

Figure 6:
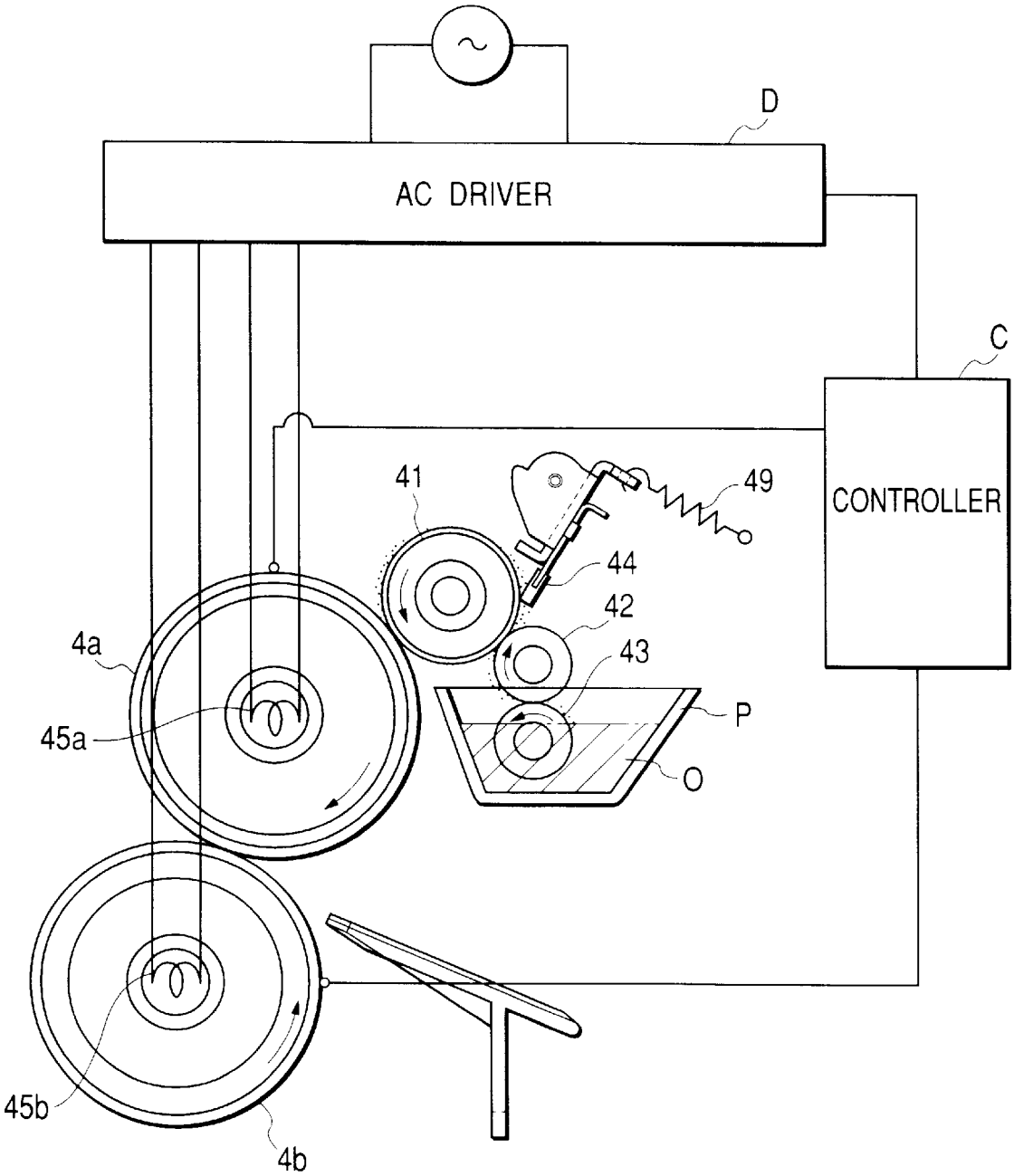
FIG. 6 is a schematic view of a fixing apparatus.

Next, the fixing unit will be described in detail with reference to FIGS. 2 and 3. Note that the construction elements that are the same as those of the apparatus shown in FIG. 6 are given the same symbols.

Figure 2:
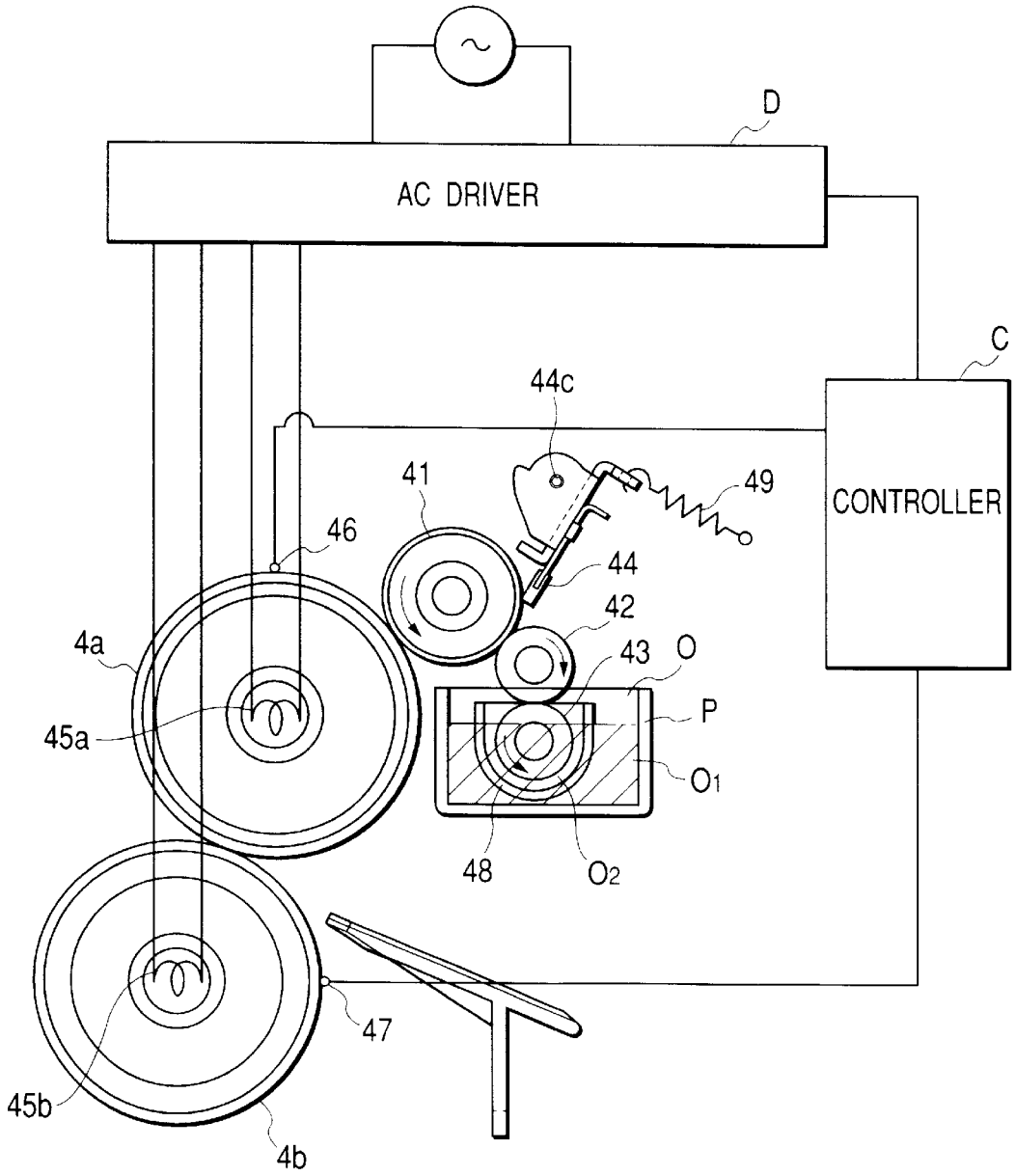
FIG. 2 is a schematic view of a fixing apparatus as an embodiment of the present invention.

FIG. 2 shows the construction of the main part of the fixing apparatus according to the first embodiment of the present invention.

In FIG. 2, each of the fixing roller 4*a* and the pressurizing roller 4*b* is formed by having silicone rubber fixed onto the upper surface of a metal core made of aluminum. Halogen heaters 45*a* and 45*b* that are heat sources are respectively disposed inside the metal cores. Thermistors 46 and 47 that contact surface layers made of the silicone rubber detect the temperatures of the surface layers, respectively.

A controller C of the main body compares the temperature detected by each thermistor with a preset temperature. If the detected temperature is lower than the preset temperature, each of the halogen heaters 45*a* and 45*b* is turned on through an AC driver D. On the other hand, if the detected temperature is higher than the preset temperature, each of the halogen heaters 45*a* and 45*b* is turned off. By controlling the halogen heaters 45*a* and 45*b* in this manner, the temperatures of the fixing roller 4*a* and the pressurizing roller 4*b* are kept constant.

Symbol O denotes silicone oil as a releasing agent, symbol P an oil pan as the outer vessel of a releasing agent containing means for containing the silicone oil O, reference numeral 43 the first draw-up roller, numeral 42 the second draw-up roller, and numeral 41 an applying roller. These construction elements are the same as those of the apparatus described above with reference to FIG. 6.

Figure 3:
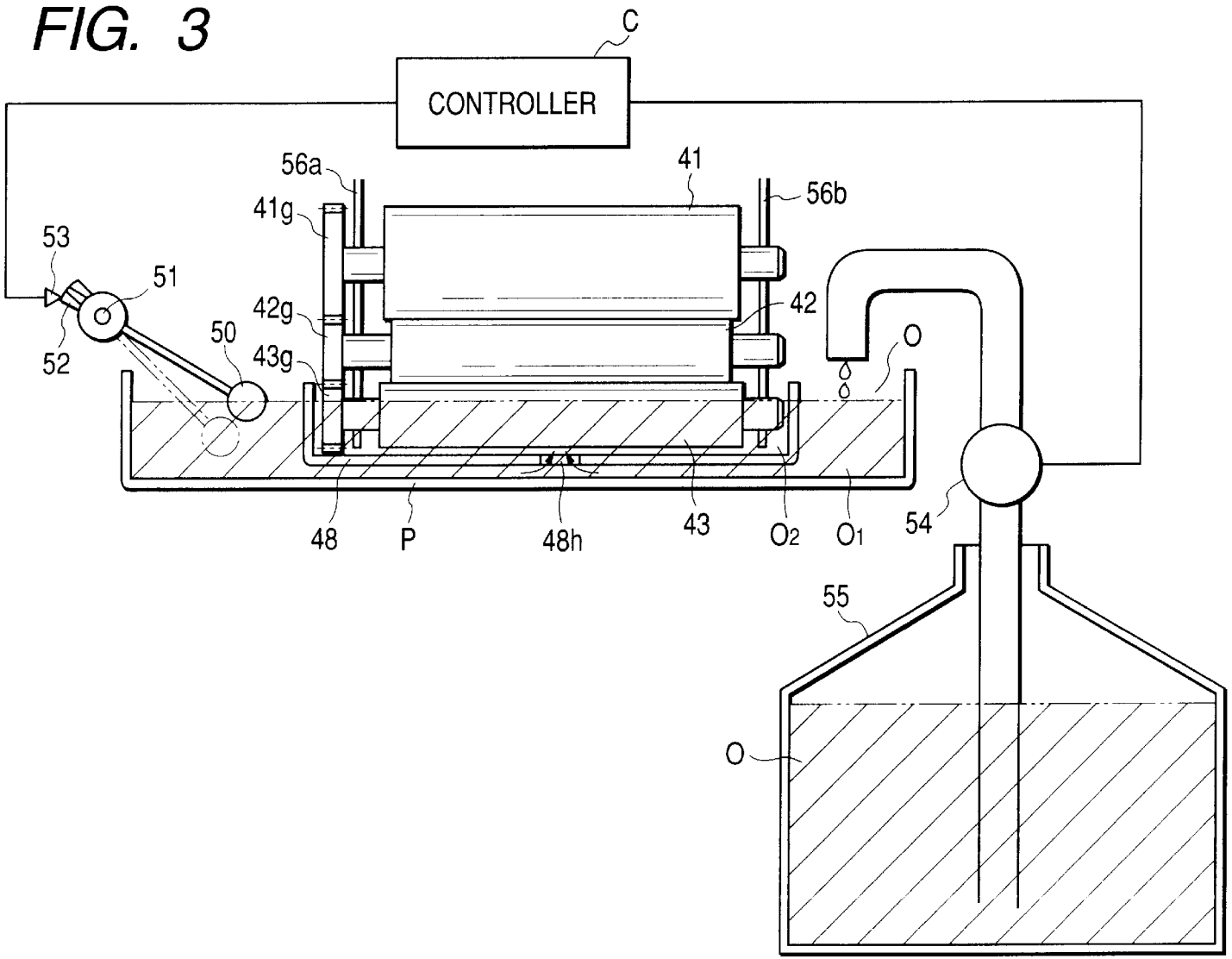
FIG. 3 is a schematic view of a releasing agent applying mechanism in the fixing apparatus shown in FIG. 2.

In FIG. 3, a gear 41*g* receives a rotational driving force from a driving force input means (not shown). The driving force is transmitted to gears 42*g* and 43*g* in succession and each of the rollers 41, 42, and 43 is rotated in each corresponding arrow direction.

Each of the rollers 41, 42, and 43 is rotatively supported by the same supporting plates 56*a* and 56*b.* Here, bearings and the like are omitted in this embodiment. However, needless to say, these rollers may be supported using slide bearings or other bearings.

In the fixing apparatus according to this embodiment, the oil O drawn up by the first draw-up roller 43 is regulated by the gap portion between the first draw-up roller 43 and the second draw-up roller 42, so that the amount of oil passing through the gap portion is regulated to some extent. In usual cases, there exists a predetermined gap (around 0.1 mm to 0.3 mm) between these first and second draw-up rollers 43 and 42. The amount of passing oil is determined by the gap and the silicone oil O passing through this gap is drawn up to the nip portion between the applying roller 41 and the second draw-up roller 42.

Then, the oil O passing through the nip portion with the applying roller 41 is conveyed by the outer surface of the applying roller 41 to a metering blade 44 as a releasing agent applying means.

The metering blade 44 is capable of rotating about a rotational center axis 44*c* and is biased against the applying roller 41 with constant pressure by a blade biasing string 49.

Accordingly, when the oil on the applying roller 41 passes through the contact portion between the applying roller 41 and the metering blade 44, the amount of passing oil is regulated to a desired constant volume. As a result, the thickness of the oil film has an optimum amount. After passing through the contact portion, the oil is applied onto the fixing roller 4*a* through the nip portion with the fixing roller 4*a*.

The oil pan P is made of a resin having excellent heat insulation property and prevents heat radiation from the oil pan P.

FIG. 3 is a diagram of the oil pan P viewed from a side thereof. A float 50 floats in the oil O in the oil pan P.

The float 50 is supported by a lever that is capable of rotating about an axis 51, and is raised and lowered in accordance with the liquid level of the oil O. Also, a flag 52 disposed on a side opposite to the float 50 is also rotated at the same time.

Accordingly, when the oil O is consumed and the remaining amount thereof becomes small, it becomes impossible for a sensor 53 to detect the flag 52. The controller C of the main body detects a signal showing this situation and activates an oil suction pump 54.

The oil suction pump 54 pumps the oil from an oil tank 55 disposed in a lower portion, thereby supplying the oil to the oil pan P.

When the sensor 53 detects the flag 52, the operation of the oil suction pump is stopped. In this manner, the liquid level of the oil O in the oil pan P is maintained constant.

Also, a surrounding member 48 that functions as an inner oil pan is provided inside the oil pan P as an outer oil pan, with the first draw-up roller 43 being surrounded by the surrounding member 48. The oil in the oil pan P is divided by this surrounding member 48 into oil in the inner oil pan and oil in the outer oil pan. There is formed an opening portion 48*h* at the center of the surrounding member 48 and the oil in the inner oil pan communicates with the oil in the outer oil pan through the opening portion 48*h*. However, the area of the opening portion 48*h* is small so that it is impossible for the oil O to freely come and go between the inner oil pan and the outer oil pan. The oil O enters from the outer oil pan to the inner oil pan to compensate for the amount of oil O drawn up by the first draw-up roller 43, thereby obtaining constant liquid levels of the oil in the inner oil pan and the outer oil pan.

The surrounding member 48 that functions as the inner oil pan is made of a resin having excellent heat insulation property and prevents heat radiation to the oil O1 in the outer oil pan. This construction makes it unnecessary to heat all of the oil O in both of the outer oil pan P and the surrounding member 48 as the inner oil pan, when an apparatus is activated. That is, it is enough to heat only the oil O2 in the surrounding member 48 as the inner oil pan. This achieves reduction of a warm-up time.

Here, a heat source for heating the oil O is the fixing roller 4*a*. Heat is transmitted from the fixing roller 4*a* to the applying roller 41, the second draw-up roller 42, and then the first draw-up roller 43, and finally reaches the oil O in the oil pan P.

All of the pumped oil is not applied to the fixing roller 4*a*, so that some oil directly receives heat from the applying roller 41 or the second draw-up roller 42. In any event, the amount of heat required is reduced in accordance with reduction of the amount of oil to be heated. Therefore, it is possible to ensure high fixability even if a warm-up time is short.

Also, a portion for drawing up the oil from the aforementioned oil tank 55 is provided at the end portion outside of the surrounding member 48 and the opening portion of the surrounding member 48 as the inner oil pan exists in the center portion. Therefore, newly drawn-up oil whose temperature is low is not directly drawn up but enters into the inside of the surrounding member 48 after being heated to some extent.

Accordingly, even during successive image formation, it is possible to evenly distribute the temperature of the oil in the surrounding member 48. This makes it possible to prevent the unevenness and variations of glossiness.

Figure 4:
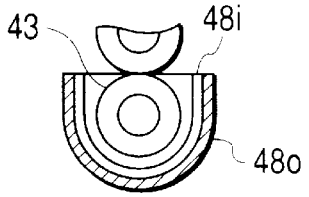
FIG. 4 shows an example of a modification of the embodiment shown in FIG. 2.

It should be noted here that as shown in FIG. 4, to uniformly distribute the temperature of the oil in the surrounding member 48*o*, the surrounding member 48*o* may be modified as follows. The inside of the surrounding member 48*o* is formed using a metal 48*i* having a high heat conductivity such as aluminum or copper, and a resin having heat insulation property is fixed to the outside of the surrounding member 48*o*.

Figure 5:
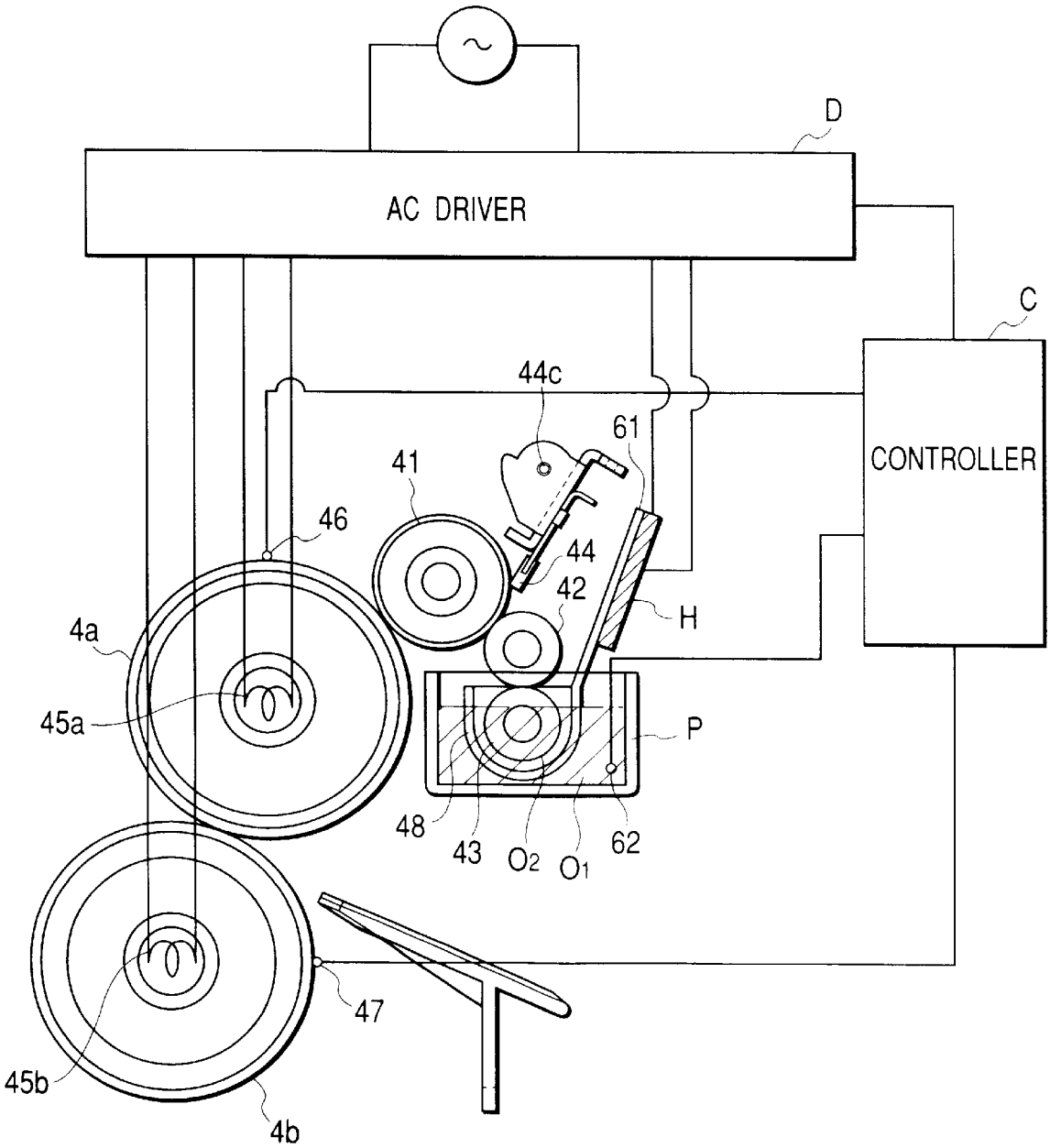
FIG. 5 is a schematic view of a fixing apparatus as another embodiment of the present invention.

FIG. 5 shows another embodiment.

The construction elements given the same symbols as those in the foregoing embodiment have the same functions and therefore the description is omitted.

This embodiment relates to an example in which the fixability is further improved by providing a heat source that is used specifically to heat the oil O.

In this embodiment, a heat transmission unit 61 is provided on a side surface of the surrounding member 48 as the inner oil pan in the longitudinal direction, with the heat transmission unit 61 extending upward from an opening end. Here, together with the surrounding member 48, the heat transmission unit 61 is formed using a metal plate having a high heat conduction, such as aluminum or copper. Also, a sheet-like heater H is fixed to the outer surface of the heat transmission unit 61. Heat generated by the sheet-like heater H is transmitted to the entire surrounding member via the heat transmission unit 61, thereby heating the oil.

Also, a thermistor 62 for detecting the temperature of the oil is disposed inside the outer oil pan P. The controller C detects the oil temperature and controls the ON/OFF of current-passage for the sheet-like heater H via the AC driver D so that the oil temperature is kept constant with respect to a set temperature.

Like in the previous embodiment, the heat transmission plate 61 is disposed so as to surround the first draw-up roller 43 and to divide the oil in the oil pan P into oil in the inner oil pan and oil in the outer oil pan. Also, like in the previous embodiment, an opening portion is provided at the center so that the oil in the inner oil pan communicates with the oil in the outer oil pan through the opening portion.

It should be noted here that the method and construction for replenishing the oil are the same as those in the previous embodiment and therefore are not described in this embodiment.

Like in the previous embodiment, the surrounding member 48 having the heat transmission unit 61 for transmitting heat to the oil O surrounds the first draw-up roller 43. As a result, the amount of oil that needs to be heated is reduced and therefore it becomes possible to shorten a warm-up time.

Also, the temperature of the oil O is adjusted in the manner described above, so that it is possible to prevent the unevenness and variations of glossiness.

To further improve thermal efficiency, like in the previous embodiment, a resin having excellent heat insulation property may be fixed to the outside of the surrounding member having the heat transmission unit 61. This construction prevents heat from escaping to the outer portion O1 that does not contribute to the drawing-up of the oil.

Also, if there is a space, the thermistor for detecting the oil temperature may be disposed inside the inner portion O2.

It should be noted here that the present embodiment has been described by taking, as an example, a case where a sheet-like heating element is used as a heater unit. However, another heat source, such as a halogen heater or a heating element employing an induction heating method, may be used in a similar manner.

As described above, with the present invention, it is possible to reduce the heat capacity of a releasing agent and also to reduce the amount of heat required to heat the releasing agent. This makes it possible to, even immediately after an apparatus is activated, secure high fixability and perform favorable fixing operations in which there occur less unevenness and variations of glossiness.

The embodiments of the present invention have been described above. However, the present invention is not limited to these embodiments and can be modified without departing from the technical idea of the invention.

What is claimed is:

1. A fixing apparatus comprising:

a fixing rotary body for fixing an unfixed image on a supporting material;

an applying member for applying a releasing liquid onto said fixing rotary body;

a containing means for containing the releasing liquid; and a supplying member contacting the releasing liquid in the containing means for supplying the releasing liquid to said applying member, wherein said containing means includes an outer vessel and an inner vessel for isolating said supplying member from said outer vessel.

2. A fixing apparatus according to claim 1, wherein said inner vessel communicates with said outer vessel and includes an opening portion for passing the releasing liquid.

3. A fixing apparatus according to claim 1, wherein said inner vessel has heat insulation property.

4. A fixing apparatus according to claim 3, wherein said inner vessel includes a heat insulating resin layer.

5. A fixing apparatus according to claim 4, wherein said inner vessel includes a high heat conduction layer provided on an inner surface of the heat insulating resin layer.

6. A fixing apparatus according to claim 1, wherein said fixing rotary body is heated by a heat source and fixes said unfixed image by applying heat thereto.

7. A fixing apparatus according to claim 1 further comprising:

a heater for heating said inner vessel.

8. A fixing apparatus according to claim 7 further comprising:

a temperature detecting member for detecting a temperature of the releasing liquid; and a control means for controlling passage of current through said heater on a basis of said temperature detected by said temperature detecting member.

9. A fixing apparatus according to claim 1, wherein the releasing liquid is silicone oil.

* * * * *

UNITED STATES PATENT AND TRADEMARK OFFICE

CERTIFICATE OF CORRECTION

PATENT NO. : 6,577,838 B2
DATED : June 10, 2003
INVENTOR(S) : Takashi Fujita et al.

It is certified that error appears in the above-identified patent and that said Letters Patent is hereby corrected as shown below:

Column 2,
Line 7, “takes” should read -- takes a --.

Signed and Sealed this

Second Day of December, 2003

JAMES E. ROGAN
*Director of the United States Patent and Trademark Office*